US012320224B1

(12) United States Patent
Atencio

(10) Patent No.: US 12,320,224 B1
(45) Date of Patent: Jun. 3, 2025

(54) VARIABLE HIGH PRESSURE TRANSITION TUBE SET POINT ADAPTER

(71) Applicant: Don Atencio, Tomball, TX (US)

(72) Inventor: Don Atencio, Tomball, TX (US)

( * ) Notice: Subject to any disclaimer, the term of this patent is extended or adjusted under 35 U.S.C. 154(b) by 259 days.

(21) Appl. No.: 18/086,414

(22) Filed: Dec. 21, 2022

Related U.S. Application Data

(63) Continuation of application No. 17/061,295, filed on Oct. 1, 2020, now Pat. No. 11,542,773, which is a continuation-in-part of application No. 16/297,432, filed on Mar. 8, 2019, now abandoned, which is a continuation of application No. 14/504,556, filed on Oct. 2, 2014, now abandoned.

(60) Provisional application No. 61/886,192, filed on Oct. 3, 2013.

(51) Int. Cl.
*E21B 33/038* (2006.01)
*E21B 33/068* (2006.01)
*E21B 34/02* (2006.01)

(52) U.S. Cl.
CPC ..... *E21B 33/068* (2013.01); *E21B 34/02* (2013.01)

(58) Field of Classification Search
CPC ..... E21B 34/02; E21B 33/068
See application file for complete search history.

(56) References Cited

U.S. PATENT DOCUMENTS 4,241,786 A 12/1980 Bullen
4,632,183 A 12/1986 McLeod
4,657,075 A 4/1987 McLeod
4,867,243 A 9/1989 Garner et al.
5,332,044 A 7/1994 Dallas et al.
5,372,202 A 12/1994 Dallas
5,785,121 A 7/1998 Dallas
5,819,851 A 10/1998 Dallas
5,927,403 A 7/1999 Dallas
5,975,211 A 11/1999 Harris
6,009,941 A 1/2000 Haynes
6,019,175 A 2/2000 Haynes
6,179,053 B1 1/2001 Dallas et al.
6,220,363 B1 4/2001 Dallas
6,247,537 B1 * 6/2001 Dallas ..... E21B 17/1007 166/242.6
6,289,993 B1 9/2001 Dallas
6,289,997 B1 9/2001 Bischel et al.
(Continued)

*Primary Examiner* — Giovanna Wright
(74) *Attorney, Agent, or Firm* — Peacock Law P.C.; Justin R. Jackson; Janeen Vilven

(57) ABSTRACT

An apparatus, method, and system for inserting and securing a high pressure transition tube of a fluid transfer tool assembly into a positive position whereby the seal element is packed off in the wellhead set point. Once attached the transition tube is pushed to contact the bit guide, secondary seal or bore machine prep. A lower nose compression seal is seated against transition tube and compressed using an energizer seal to isolate and protect lower pressure wellhead and well control equipment from the higher rated frack pressures or pushing the transition tube and lower nose isolation compression seal to contact the bit guide, secondary seal or bore prep. Pressure is applied to push a seal against the lower and upper compression ring locking them in place preventing movement to form a compression seal and isolating the high pressure passing through the transition tube protecting the wellhead assembly and well control equipment.

16 Claims, 10 Drawing Sheets

(56) References Cited

U.S. PATENT DOCUMENTS

| | | | | |
|---|---|---|---|---|
| 6,364,024 | B1 | 4/2002 | Dallas | |
| 6,626,245 | B1 * | 9/2003 | Dallas | E21B 17/1007 166/85.4 |
| 6,666,266 | B2 | 12/2003 | Starr et al. | |
| 6,712,147 | B2 | 3/2004 | Dallas | |
| 6,817,423 | B2 | 11/2004 | Dallas | |
| 7,308,934 | B2 | 12/2007 | Swagerty et al. | |
| 7,490,666 | B2 | 2/2009 | Swagerty et al. | |
| 8,327,943 | B2 | 12/2012 | Borak et al. | |
| 8,950,483 | B2 | 2/2015 | Mason et al. | |
| 2003/0192698 | A1 | 10/2003 | Dallas | |
| 2012/0205111 | A1 | 8/2012 | Udipi et al. | |
| 2021/0017836 | A1 | 1/2021 | Atencio | |

* cited by examiner

VARIABLE HIGH PRESSURE TRANSITION TUBE SET POINT ADAPTER

CROSS-REFERENCE TO RELATED APPLICATIONS

The present application is a continuation application of U.S. patent application Ser. No. 17/061,295, filed on Oct. 1, 2020, which itself is a continuation-in-part of U.S. patent application Ser. No. 16/297,432, filed on Mar. 8, 2019, which itself is a continuation application of U.S. patent application Ser. No. 14/504,556, filed on Oct. 2, 2014, which itself claims priority to U.S. Provisional Application No. 61/886,192 filed Oct. 3, 2013, and the specifications and claims (if any) of those applications are incorporated herein by reference.

BACKGROUND OF THE INVENTION

The presently claimed invention relates to oil and gas drilling systems, and more particularly to systems for insertion tools, for inserting and securing a high-pressure transition tube of a fluid/gas, and a transfer tool apparatus assembly into a positive position in which the seal element is packed off in the wellhead set point. The claimed invention can be used for the process of fracking, a method developed and used to crack open the formation at high pressures and to help the stimulations of oil and gas well production, and a tool, apparatus, and a configuration equipment and method for protecting frack containment and control equipment and wellhead from exposure to pressures higher than the pre-design operating range and from the abrasive and or corrosive fluids during well fracturing and pumping procedures.

Wells require some form of stimulation called fracking to stimulate production and make or keep them productive. The fracking of oil and gas wells formations to stimulate production requires that high pressure pumping equipment be used to inject fluids, chemicals, and sands at high pressures. The frack fluids are generally corrosive and abrasive because of acids and abrasives used to open cracks in the formations with special sand.

New technology and methods as well as safety and environmental regulations that are being adopted industry wide cannot be accomplished with the lower pressure frack containment equipment, Blowout Preventers (BOPs) or through a valve attached to the wellhead. The practice of fracking or pumping through BOPs equipment, valves or wellheads at pressures higher that the pre-engineered design pressure rating has been determined to be unsafe and is no longer Standard Operating Practice (SOP).

This method was adopted because it was the only way to have full access to a well casing bore with down-hole tools during the well fracking or servicing. The industry's known methods and technologies indicate that new methods must be developed to acquire full bore access to well bore at much higher pressures. Full bore access to the casing permits use of down-hole tools that are often required during a frack stimulation treatment without having to remove tools or equipment between multi-stage frack stimulation, as was required with older style conventional wellhead isolation tools such as disclosed in U.S. Pat. No. 4,867,243, entitled WELLHEAD ISOLATION TOOL AND SETTING AND METHOD OF USING SAME.

An apparatus for providing full access to the casing while permitting stimulation treatments at extreme pressures that approach a burst pressure rating of the casing is described in U.S. Pat. No. 6,289,993, entitled BLOWOUT PREVENTER PROTECTION AND SETTING TOOL.

Another reference describes an apparatus and method of isolating a well tree located on an oil or gas well from the effects of high pressure or corrosion caused by stimulation of a well is described in U.S. Pat. No. 4,867,243 entitled WELLHEAD ISOLATION TOOL AND SETTING TOOL AND METHOD OF USING SAME. This reference describes an apparatus to permit the injection of fluids, gases, solid particles, or mixtures through a well tree while protecting the well tree during well stimulation treatments. The apparatus includes a single hydraulic cylinder supported in an axial alignment over a well tree by at least two elongated support rods. The hydraulic cylinder support rods are connected between a base plate and a hydraulic cylinder support plate for supporting the hydraulic cylinder above the well tree at a distance approximately equal to the height of the production tree.

This device permits the insertion of a single length of high pressure tubing through any well tree regardless of its height. Once the high-pressure tubing is seated in a well tubing or casing, the hydraulic cylinder, hydraulic cylinder plate, and support rods are removed to provide 360 degrees of access to a high-pressure valve attached to the top of the high-pressure tubing. The bottom end of the high-pressure tubing has a packoff nipple assembly that is inserted into the production tubing or casing and seals against the inner wall. Thus, the extent to which the high pressure tubing extends into the production tubing or casing is unimportant so long as the packoff nipple assembly is sealed against the inner wall. Consequently, variations in the length of the production tree are of no consequence and a lockdown mechanism with a short reach is adequate. Therefore, there exists a need for a mechanical lockdown mechanism that provides a broad range of adjustment to permit packoff with a fixed packoff surface in a wellhead.

BRIEF SUMMARY OF THE INVENTION

The presently claimed invention overcomes the shortcomings of the prior art by providing a locking mechanism, described as a variable adjuster locking sleeve, which houses and forms a barrier around a high pressure transition tube. The variable adjusting locking sleeve is capable of up and down vertical movement while simultaneously providing a pressurized barrier around the variable high pressure transition tube and in the unibody master housing with test ports to verify seal integrity. Additionally, the presently claimed invention prevents exposure of the barrel, which creates safety and environmental hazards if a breach or internal wash or damage occurs.

When the mechanical locking mechanisms are attached or applied, the variable adjuster sleeve houses the high pressure variable transition tube and assembly to achieve a double barrier pressure seal and a double retention locking ring, which are not available in prior art. The claimed invention greatly improves the art of wellhead equipment isolation tools and the protection from high pressures, corrosive chemicals, and abrasive sand to well control equipment, blowout preventers (BOPs), flow control valves, flow spools other equipment known in the industry by sealing and protecting from high well pump frack stimulation pressures, and to overcome the design shortcomings, safety and environmental concerns of the prior art.

It is the intention of the presently claimed invention to provide an isolation seal barrier for protection of well control equipment and safe operation for personnel and environmental protection while still accessing high-pressure fracking technology during the well stimulation process and treatment.

It is also a further object of the presently claimed invention to provide an isolation seal barrier for protection from high pressures, corrosive chemicals, and abrasive sand-to-well control equipment such as blowout preventers (BOPs), flow control valves that are secured and locked into position by a mechanical locking mechanism capable of sealing and providing a pressure protection barrier. It is a further object of the present invention to provide a safety and environmental protection to personnel and environment through engineering design.

In accordance with one aspect of the presently claimed invention, there is provided, an apparatus for protecting well control equipment from exposure to fluid pressures, abrasives, and corrosive fluids used in well treatment to stimulate production. The apparatus comprises a high pressure transition tube adapted to be inserted down through the well control equipment to an operative position. The high pressure transition tube has a top end and a bottom end, the high pressure transition tube bottom end including prep for a hollow nose bullet sealing assembly for sealing engagement in the wellhead casing seal with a top metal energizer ring seated on top of the casing seal bit guide. The assembly is compressed when weight or force is introduced compressing the seal between the steel energizer rings, thus, forcing an elastomer seal to compress and expand outward against the wall of the wellhead bore, thus, eliminating the need to have a controlled tolerance or pre-engineered measurements or dimensions such as are needed with o-ring style seals.

When the high pressure transition tube and hollow nose bullet seal are in the operative position, a mechanical lockdown mechanism detachably secures the high pressure transition tube to the well control equipment. The lockdown mechanism being adapted to ensure that the hollow nose seal assembly sealing body is securely seated against the top of the casing and in the wellhead secondary seal when the high pressure transition tube is in the operative position. The mechanical lockdown mechanism preferably includes a variable adjuster locking sleeve, high pressure variable transition tube, hollow nose seal assembly, and a unibody master housing that is manufactured to universal API 6A standards. The variable high pressure transition tube mechanical lockdown mechanism is mounted to a top of the well control equipment, and the variable tube housing adapter has a centered passage port to permit the installation and removal of the variable tube. The passage port provides housing for the high pressure variable tube sleeve that has machined thread for engaging the high pressure variable tube and a high pressure adapter or well control valve. The high pressure adapter or well control valve is adapted to secure and retain the high pressure tube and high pressure variable seal assembly in the operative position. The variable transition tube spiral thread length is adequate to ensure positive retention and safe operation at well stimulation fluid pressures such as 10,000 to 15,000 Pounds per Square Inch (PSI).

The high pressure variable pass-through tube has at least one external and one internal spiral thread, and one on the high pressure variable transition tube adjuster adapter. The high pressure variable transition tube adjuster adapter has a length adequate to provide a significant range of adjustment, preferably at least about 5" (12.5 cm), to compensate for variations in a distance between a top of the closing equipment (valve and/or BOP), the secondary seal assembly, and bore wall of the tubing head assembly, where the high pressure variable seal assembly inserts into the casing seal prep profile and packs off. The mandrel may be cycled in and passed through the well control equipment using any type of mechanical push/pull mechanism for the insertion of high pressure variable tube assembly or wellhead saver. Once inserted, the high pressure variable tube assembly is securely locked in its operative position by adjusting the variable adjustment pressure adapter until it contacts the frack adapter head retainer mechanical locking mechanism, and is locked in the optimum position.

The presently claimed invention provides a method for protecting the tubing head wellhead assembly, well control equipment, and other equipment from exposure to abrasive, and corrosive fluids and pressures above the intended manufactured design during a well frack and stimulation process. The tool assembly comprises a variable high pressure transition tube, a unibody high pressure transition valve or frack valve adapter head designed to be inserted down through the well control equipment and connected to a top end variable adjuster locking sleeve adapter. The unibody high pressure transition valve or valve adapter head is adapted to and connected to the variable high pressure transition tube and protrudes above the unibody master housing, well control equipment, and the variable high pressure transition hollow nose bull seal. The variable high pressure transition hollow nose bull seal assembly end includes a wellhead through bore wall elastomer compression seal and at least one sliding sleeve energizer ring when inserted for sealing with a secondary back up compression energized seal. The secondary compression energized seal compresses with force against the wellhead through bore wall when the hollow nose bullet seal assembly and variable high pressure transition tube are locked into position.

A mechanical push/pull insertion mechanism is used for inserting the variable high pressure tube into and removes the variable high pressure tube in and out of the well control equipment. The mechanical push/pull insertion mechanism is supported by at least two elongated variable shank rods attached to the unibody master housing shank rod plate and integrated API flange. The unibody master housing API flange is sized to mate to the well control equipment for supporting the mechanical push/pull insertion mechanism in vertical and axial position set above the well control equipment and high pressure transition tube unibody master housing and shank rod plate. The shank rods and the mechanical push/pull mechanism are removable once the unibody pressure transition valve and variable high pressure transition tube and hollow nose bullet seal assembly are inserted through the well control equipment.

A primary advantage of the presently claimed invention is the use of a variable adjuster locking sleeve adapter. The variable adjuster locking sleeve adapter locking mechanism has several advantages that make it superior to the prior art. One primary advantage is the double barrier design that encapsulates and houses the variable high pressure transition tube, whereby the variable adjuster locking sleeve adapter allows the high pressure variable tube to pass and slide through, and up and down while maintaining a back pressure seal during the in and out installation process.

Another advantage of the presently claimed invention is that the high pressure transition tube is completely housed and sealed by the variable adjuster locking assembly. The variable adjuster locking sleeve adapter is designed with internal and external seals that can be externally hydraulically tested for seal integrity.

Another advantage not available in prior art is that the variable adjuster locking sleeve adapter is also fitted with metal to metal ring seal, that once locked down into place forms a double barrier seal. This is optimal because even if the high pressure variable tube is damaged, breached, or washed through, it is contained within the outer shell of the variable adjuster assembly with seals the contain pressure internally to safely protect personnel and the environment.

Other advantages of the presently claimed invention are quick connecting double retention for rods and low profile for easy access to well control equipment. In addition, the security provided by a mechanical double lockdown mechanism is independent and provides a back-up lock further securing to ensure retention of the high pressure transition tube that eliminates safety and environmental concerns.

Other advantages include the ability to pressure test high pressure transition tube seals for integrity, and a removable shank rod plate and adjustable shank rods are configured to fit different variations of equipment lengths, which reduces cost and offers versatility.

Furthermore, the separable shank plate's adjustable rods, the quick connect guides, and removable insertion tool reduces manufacturing and maintenance costs of the apparatus.

BRIEF DESCRIPTION OF THE SEVERAL VIEW OF THE DRAWINGS

The accompanying drawings, which are incorporated into and form a part of the specification, illustrate several embodiments of the presently claimed invention, and together with the description, serve to explain the principles of the presently claimed invention. The drawings are only for the purpose of illustrating a preferred embodiment of the claimed invention and are not to be construed as limiting the presently claimed invention.

Figure 7:
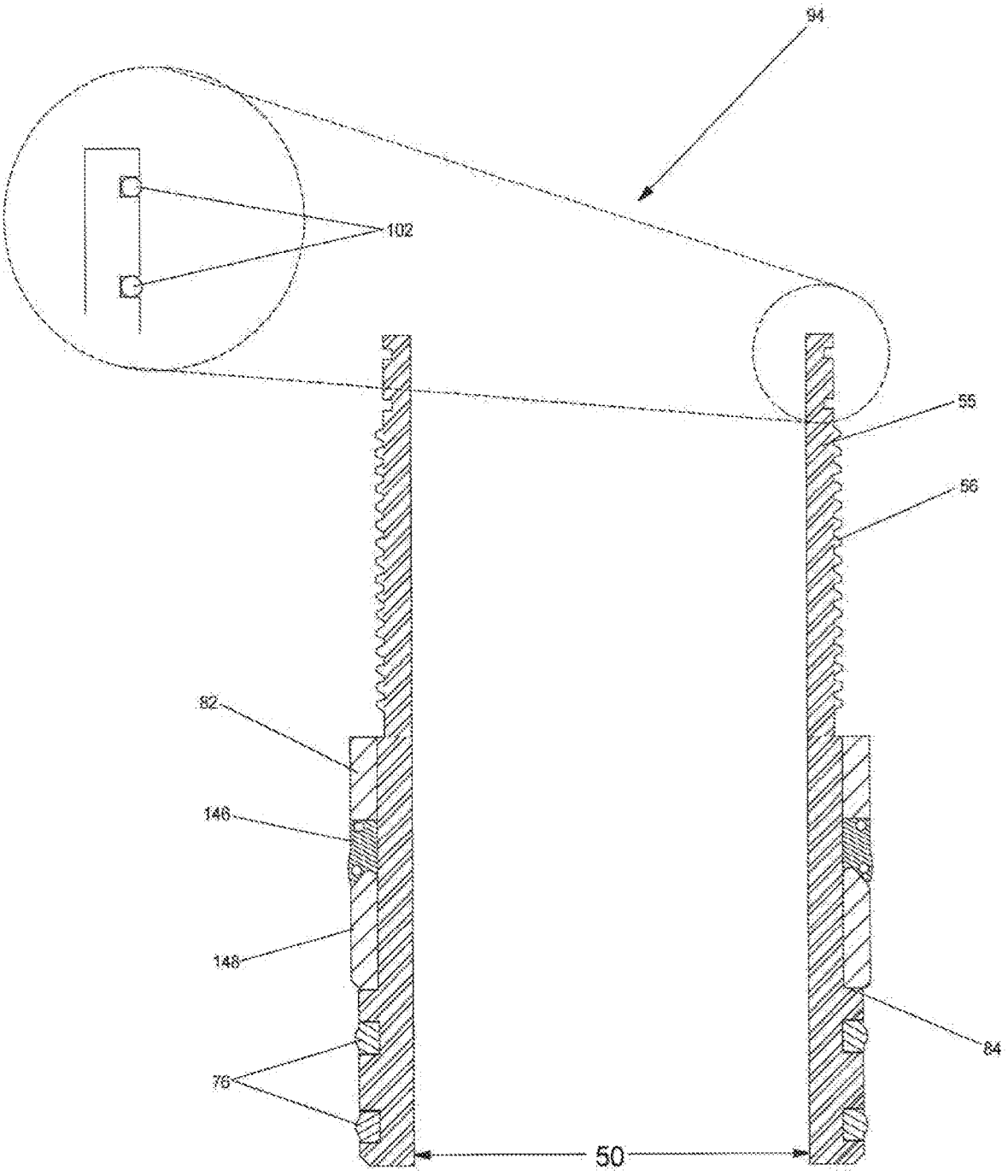

FIG. 7 is a partial cross-sectional view of an alternate preferred embodiment of an annular sealing body for sealing against the inner wall of the well control equipment with a metal to metal compression ring that seats or butts up to the tool guide of the casing seal. It is then compressed by force, which preloads and energizes the seal or seals against the inner wall of well control equipment to positively provide a seal.

Figure 5A:
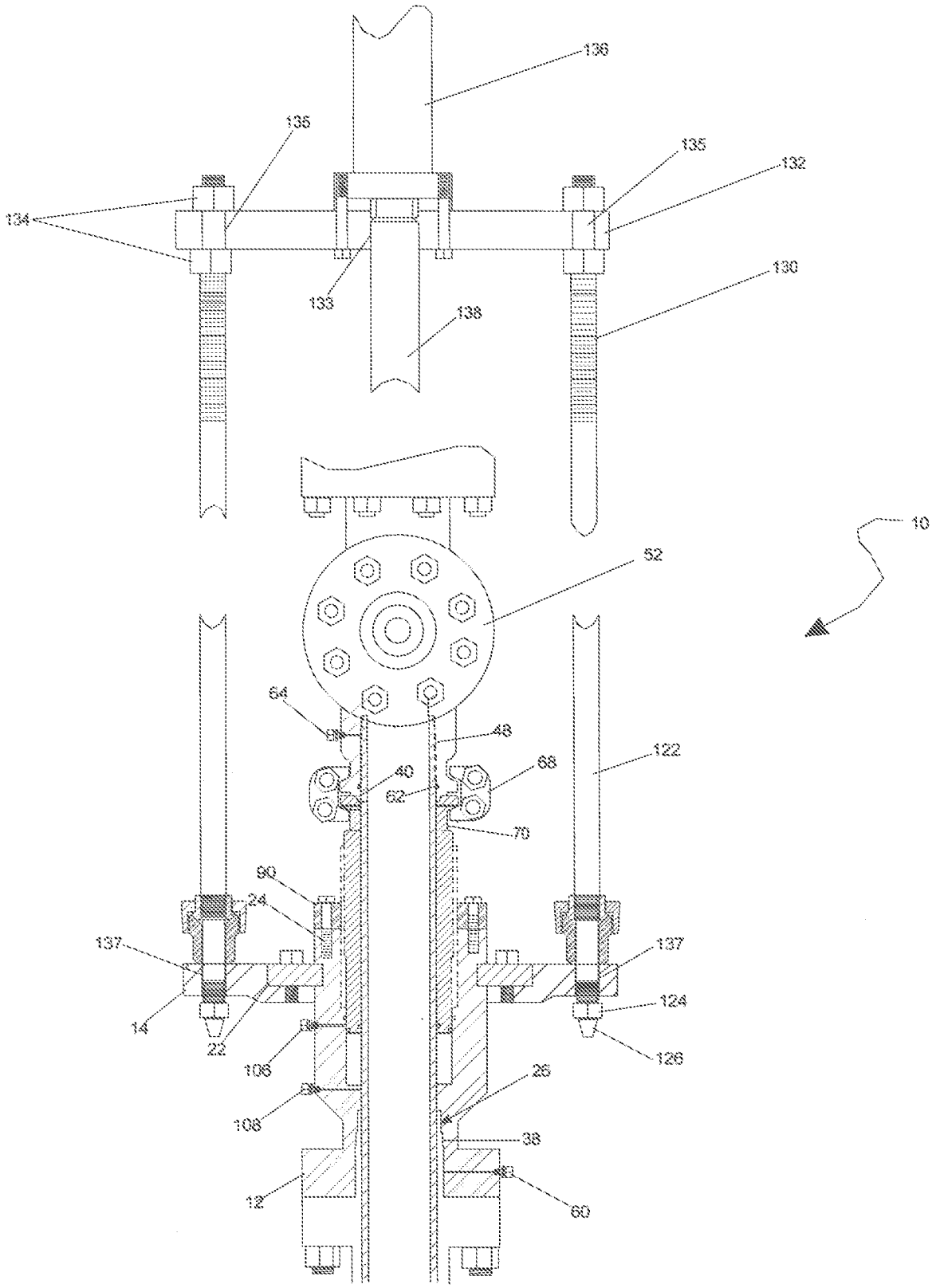
FIG. 5A is a front view of the variable high pressure transition tool assembly mounted on well control equipment with the upper and lower shank rod plate assemblies and ram assembly mounted to the shank rod plate with variable adjustable shank rods.
Figure 5B:
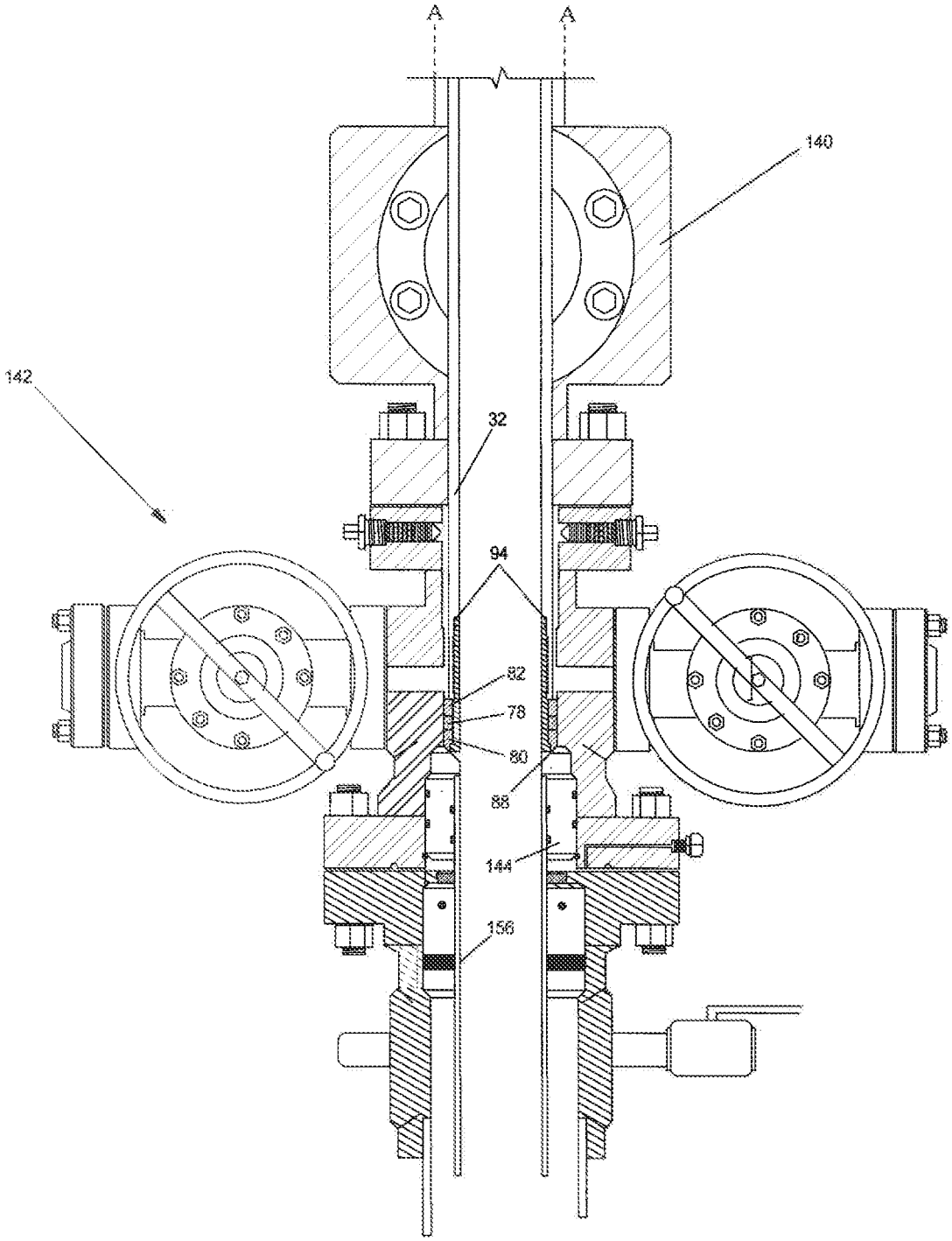
FIG. 5B is a partial cross-sectional view of a variable high pressure transition tube and an embodiment of seal assembly inserted and attached to a variable high pressure transition tube for sealing against an inner wall of well control equipment.
Figure 8:
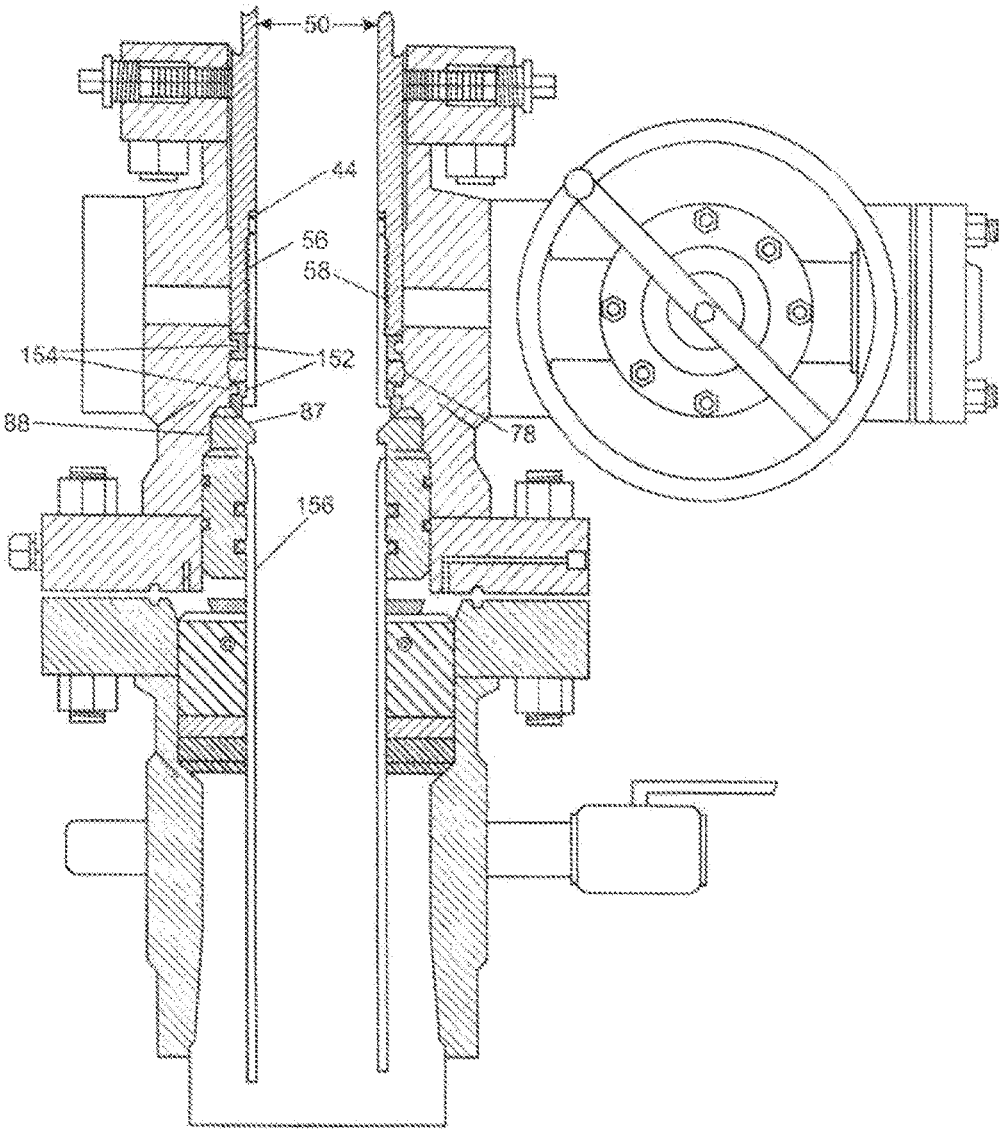

FIG. 8 is an embodiment of an alternate seal of FIG. 5B illustrating a metal ring in contact with a casing secondary seal bit guide used to energize an elastomer or polyurethane seal when pressure is applied and used to compress the seal against the body of the wellhead bore. This force pushes the seal outward against the bore, which does not require controlled tolerances.

DETAILED DESCRIPTION OF THE INVENTION

Figure 1A:
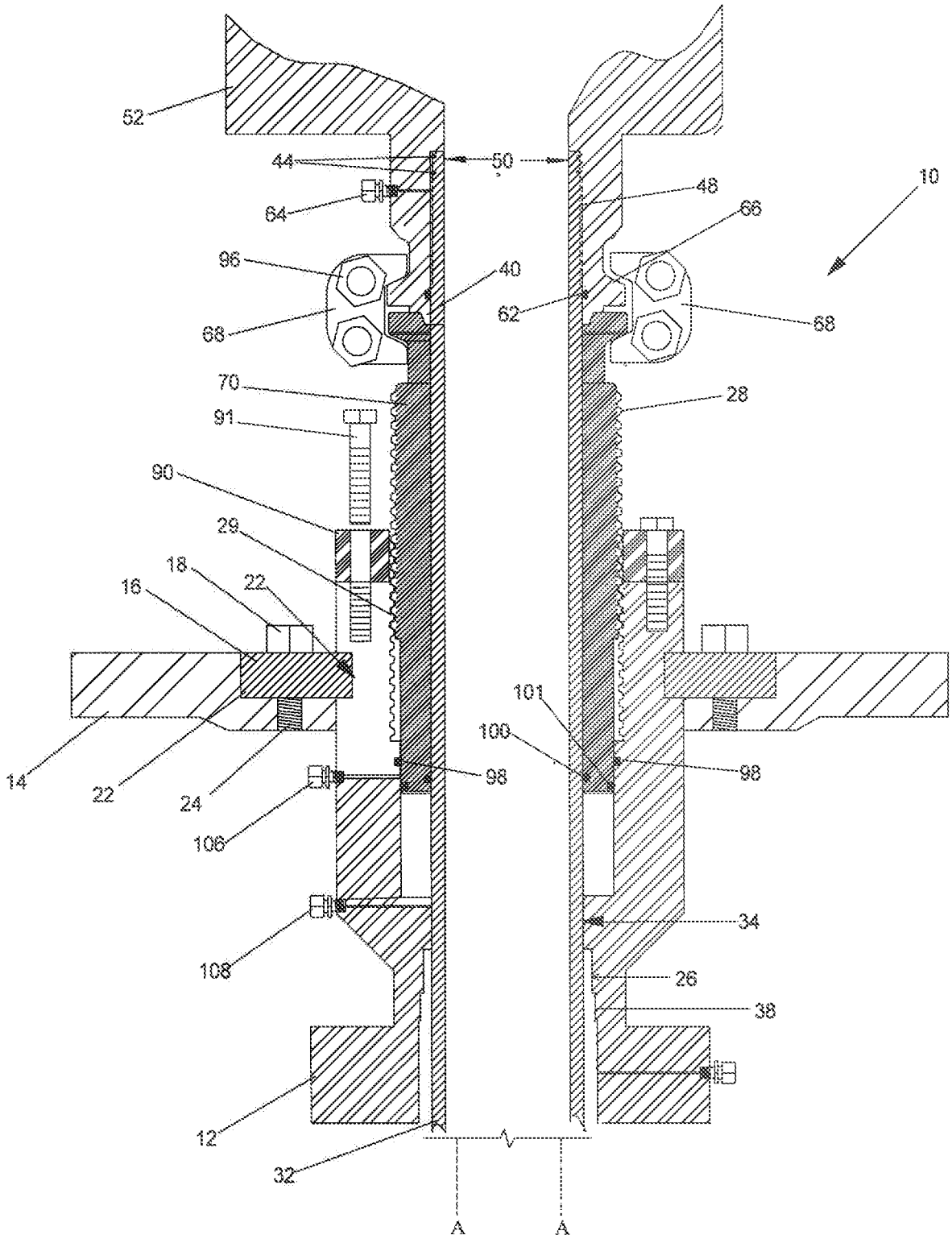
FIG. 1A is a drawing which illustrates a cross sectional view of an upper portion of a variable pressure isolation tool according to an embodiment of the present invention.
Figure 1B:
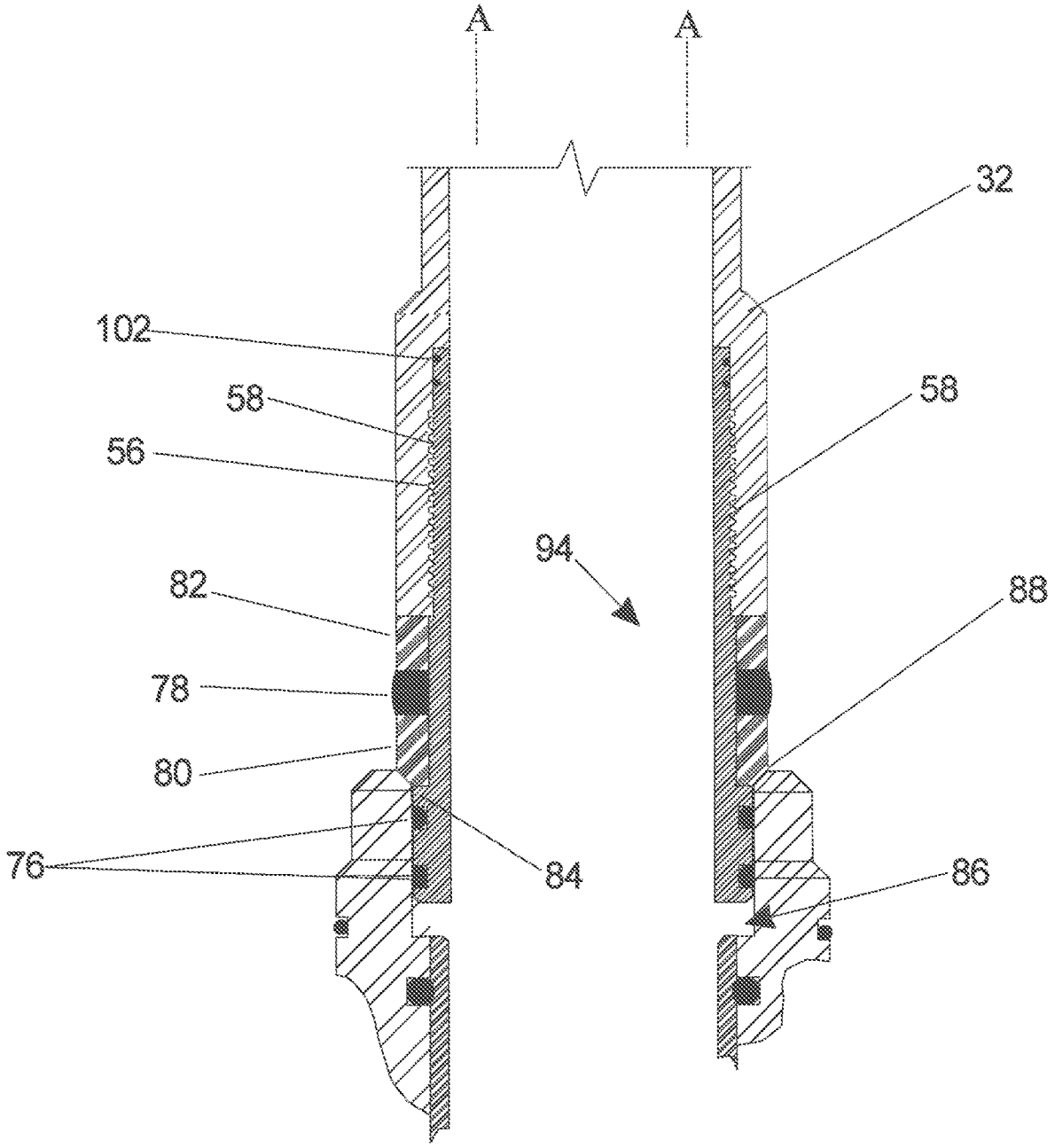
FIG. 1B is a drawing which illustrates a cross sectional view of a bottom portion of a high pressure variable tube assembly with the hollow bullet nose seal assembly installed in the variable tube and inserted into a wellhead casing secondary seal according to an embodiment of the present invention.
Figure 2:
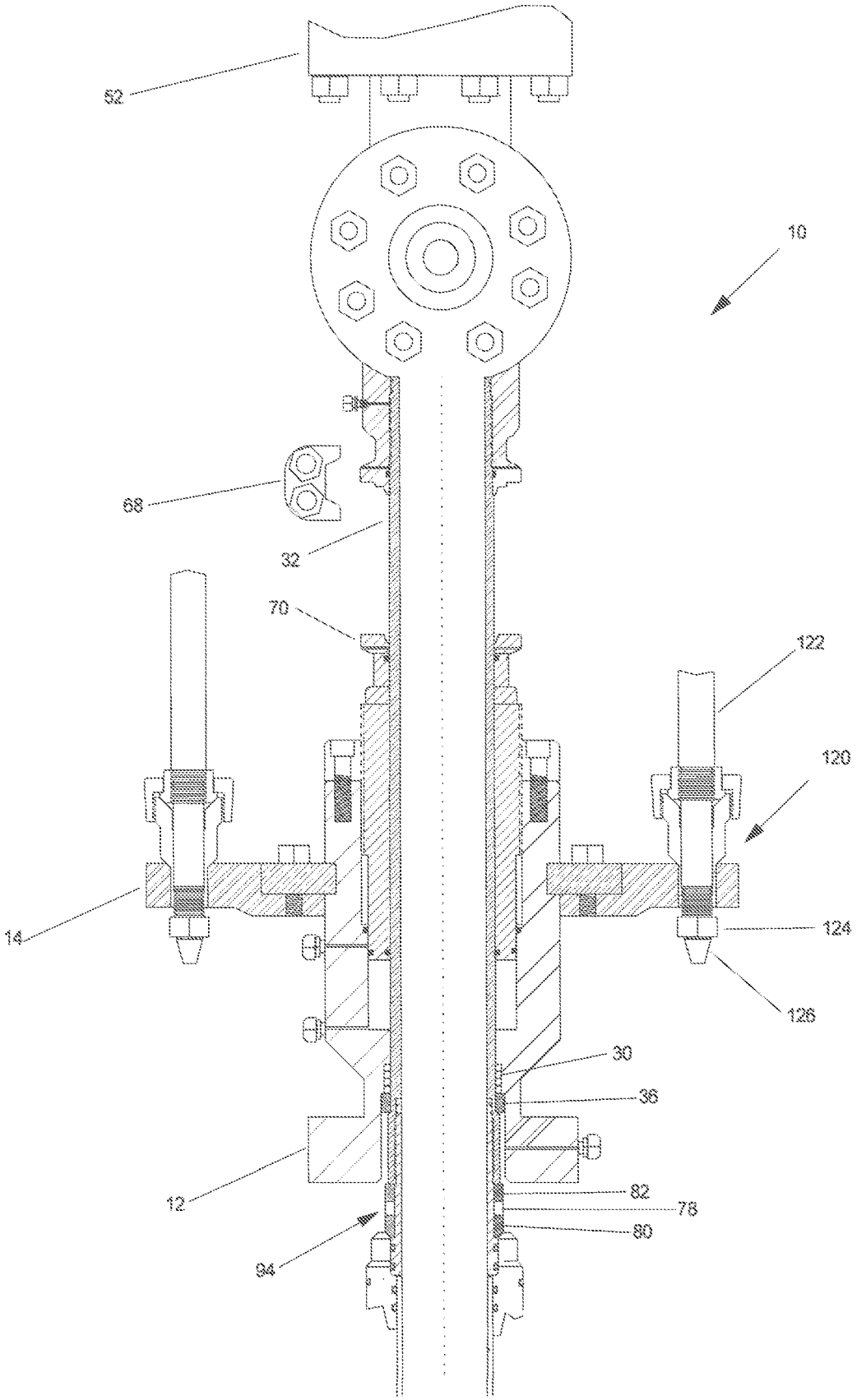
FIG. 2 is a drawing which illustrates a cross-sectional view of the variable adjuster locking assembly and unibody master housing assembly with variable adjuster locking sleeve assembly disengaged.

FIGS. 1A and 1B show a cross-sectional view of the variable high pressure transition tool for protecting the wellhead control equipment (hereinafter referred to as variable pressure isolation tool 10). Variable pressure isolation tool 10 includes unibody master housing 12, lower shank rod plate 14 that is drilled and preferably tapped with bolt threads positioned around the radius of lower shank rod plate 14. Shank rod plate bolts 18 are affixed to lower shank rod plate 14 and to split locking ring 16 that are then placed into position on unibody master housing 12 by sliding lower shank rod plate 14 over the top of unibody master housing 12. Unibody master housing 12 can also include at least two or more split locking rings 16 that include bolt holes around the radius of split locking ring 16 with vertically aligning holes in lower shank rod plate 14. Split locking rings 16 are inserted into position in unibody master housing locking ring slot groove 22. Lower shank rod plate 14 is then lifted into position, and the hole aligned with split locking ring 16. One or more shank rod plate bolts 18 are inserted into the aligned holes and rotated into retainer ring bolt threads 24 and tightened or torqued into position. Unibody master housing 12 is machined and configured with tube seal pocket 26, fitted and sized with tube seal 30 interference against the vertical wall of tube seal pocket 26 that will accept one or more tube seals 30. Variable high pressure transition tube 32 is inserted into and through vertical bore 34 of unibody master housing 12 and one or more tube seals 30 (see FIG. 2) are inserted and placed into position around variable high pressure transition tube 32. Packing retainer ring 36 (see FIG. 2) is placed around variable high pressure transition tube 32 and slid into position until packing retainer ring 36 makes contact with retainer ring threads 38, and is then rotated into position and locked in place. Variable high pressure transition tube 32 is fitted with a high pressure ("HP") nose seal prep that receives one or more upper tube seals 44 with spiral threads 46 to engage with complementary threads 48 and tube bore 50. Tube bore 50 (see FIG. 1A) should be large enough to provide full access to the well bore casing as shown in FIG. 2. Threads 56 of hollow bullet nose seal assembly 94 are used to engage with threads 58 of variable high pressure transition tube 32 and at least one upper tube seal 102. Control valve 52 has a variable tube test port 64 that enables testing from 10,000 to 15,000 PSI on upper tube seal 44, and lower outer variable tube seals 62 for safety and seal integrity. Control valve 52 includes a flanged or winged hub 66 which can be secured with clamp 68. Extension plate 90 is preferably attached to unibody master housing 12 via bolt 91.

Variable high pressure transition tube 32 is also adapted with a variable adjuster locking sleeve 70 with threads 28, which are most preferably spiral variable adjustable threads, that are provided externally for adjusting the sleeve up or down into position to mate with the setting position of control valve 52 and variable high pressure transition tube 32. Variable adjuster locking sleeve 70 is fitted with inner seal 100 and outer seal 101 to prevent escape or spill of any pressurized liquids that might be present should compression seal 78 and tube seal 30 be damaged or have a leak between hollow bullet nose seal assembly 94 and wellhead seal prep 86. Hollow bullet nose seal assembly 94 is fitted with threads 56 have at least one compression seal 78, which is most preferably an external seal that is formed from an elastomer material, and lower energizer ring 80. Lower energizer ring 80 is installed by placing it over and sliding it past threads 56 and lowering it to no go stop 84. Compression seal 78 and upper energizer ring 82 are installed using the same steps.

Hollow bullet nose seal assembly 94 is installed into variable high pressure transition tube 32 by rotating threads 56 and 58 until hollow bullet nose seal assembly 94 stops rotating and is fully engaged. When hollow bullet nose seal assembly 94 engages and is set inside wellhead seal prep 86 with lower energizer ring 80, it stops on top of wellhead seal bit guide 88. Force is applied by means of weight or hydraulic to the top of variable pressure isolation tool 10 which forces upper energizer ring 82 to push against compression seal 78 and lower energizer ring 80 compressing and preloading compression seal 78 against the wellhead vertical wall. Variable adjuster locking sleeve 70 is usually pre-set to the lowest operation position of variable length adjustment 74 by rotating clockwise or counter clockwise on threads 28 of the variable adjuster tube sleeve and master housing thread 29 to match the final optimum setting position of hollow bullet nose seal assembly 94 and control valve 52. Clamp 68 is installed and locked onto the flange or winged connection using clamp bolts 96.

Variable adjuster locking sleeve 70 is fitted with well-known types or methods for locking clamping or bolting it (for example via clamp 68) to secure seal ring prep 40, which is most preferably a steel seal ring prep. This provides a backup pressure containment barrier if tube seal 102 or tube seal 30 fails. Variable adjuster locking sleeve 70 is fitted with inner seal 100, outer seal 101 and master housing seal 98 to prevent exposure and spills should outer seal 101, hollow bullet nose seals 76, or compression seal 78, and tube seal 30 fail. Variable adjuster locking sleeve 70 also provides passage bore 104 (see FIG. 4) for variable high pressure transition tube 32 to pass through and travel up and down or in and out of passage bore 104. Unibody master housing 12 is fitted with upper test port 106 to test master housing seal 98 and/or outer seal 101 for seal integrity. Lower test port 108 provides for testing inner seal 100 and tube seal 30 for seal integrity.

Figure 3:
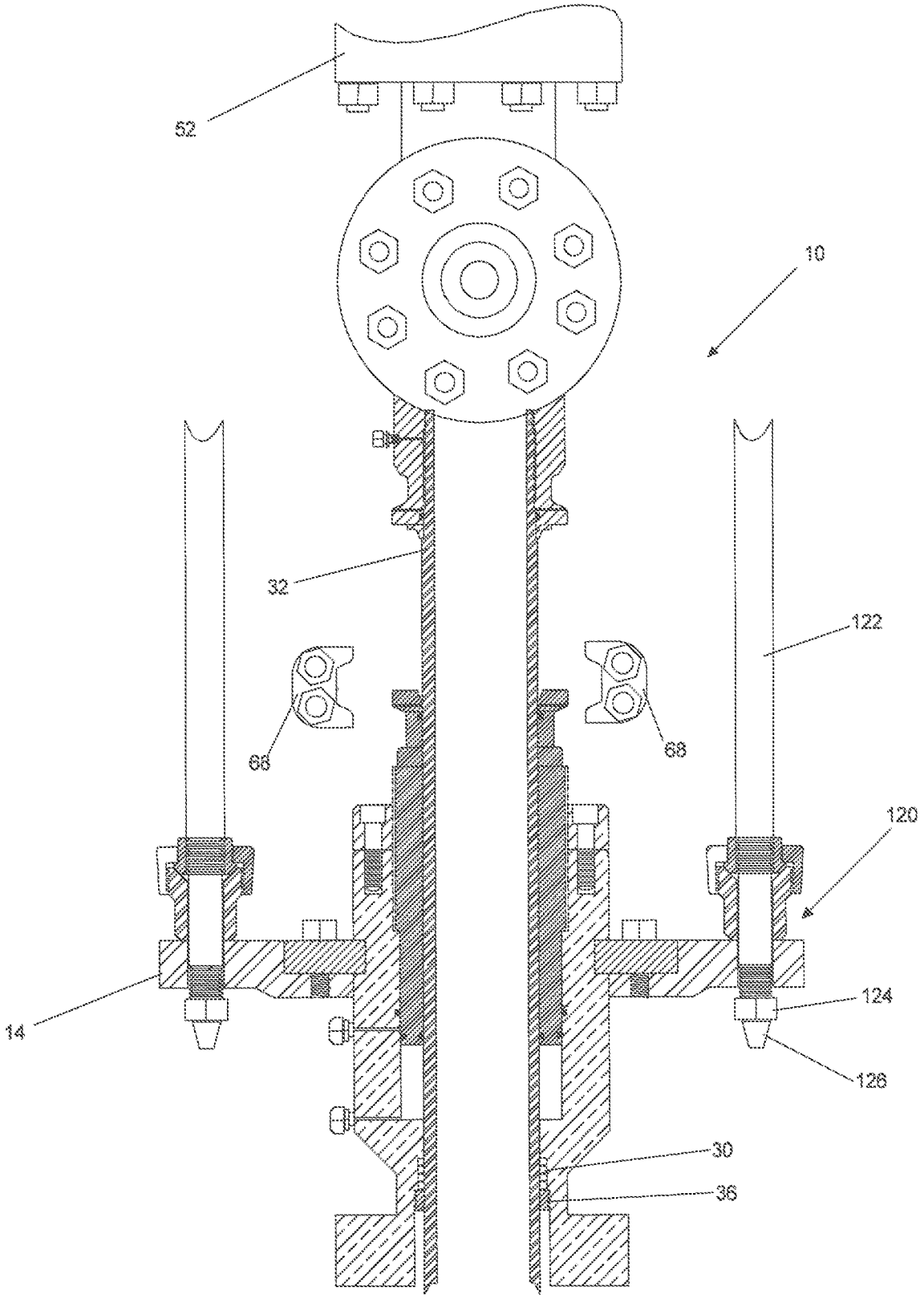
FIG. 3 is a front view of unibody master housing assembly cross section with high-pressure variable transition tube and quick connect shank rod connection assembly mounted to the shank rod plate with shank rod inserted and securely locked into position with a safety back up lock nut installed.

FIGS. 2 and 3 illustrate the variable high pressure transition tool of FIGS. 1A and 1B, prior to being mounted above well control equipment for a well stimulation treatment. Clamp 68 is removed from variable adjuster locking sleeve 70 and the lockdown mechanism is disengaged from control valve 52 and away from unibody master housing 12. Lower shank rod plate 14 and control valve 52 are connected to the top end of variable high pressure transition tube 32, which includes any required proper variable high pressure transition tube length section(s) and hollow nose bullet seal assembly 94 to provide a total length required for a particular well control equipment or wellhead. Unibody master housing 12 is mounted on the top end of the well control equipment or blow out preventer ("BOP") and the combination of control valve 52 with clamp 68 and variable high pressure transition tube 32, are inserted from the top into the well control equipment or BOP using any one of several insertion tools known in the industry. Lower shank rod plate 14 is fitted with at least two or more rod quick connect assemblies 120 for attaching upper rod shank plate 132 (see FIG. 5A) and lower shank rod plate 14, at least two or more variable rod shanks 122, and at least two or more rod safety nuts 124 for backup security while inserting or pulling under pressure.

Figure 4:
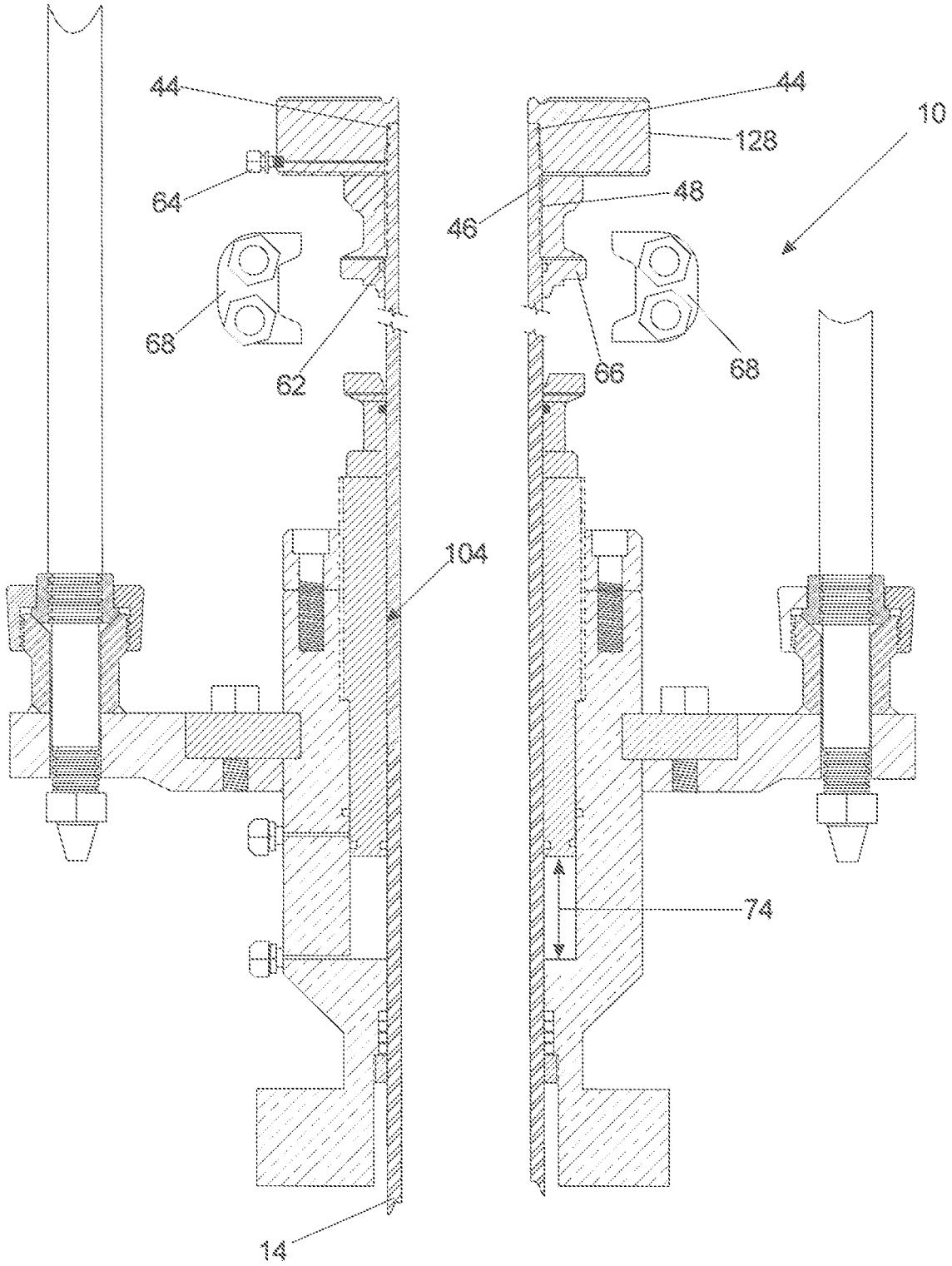
FIG. 4 is an alternate flanged frack valve adapter embodiment to the unibody pressure transition control valve adapter and locking clamp mechanism used in the high pressure transition tube well control equipment protector.

FIG. 4 illustrates a flanged end valve adapter 128 fitted with female HP nose seal prep which holds upper tube seal 44. Flanged end valve adapter 128 has spiral threads 46 to engage with complementary threads 48 of variable high pressure transition tube 32 that have at least one upper tube seal 44. Flanged end valve adapter 128 has a variable tube test port 64 that enables testing of 10,000 to 15,000 PSI on upper tube seal 44 and lower outer variable tube seals 62 for safety and seal integrity. Flanged end valve adapter 128 is secured by applying clamp 68 onto its flange or winged hub 66.

The variable high pressure transition tool in FIGS. 5A and 5B illustrate an example of the use of well control equipment and variable pressure isolation tool 10, shown in FIGS. 1A and 1B, using a hydraulic setting tool as described in U.S. Pat. No. 4,867,243, which is incorporated herein by reference. The tool is connected to casing well bore by various casing methods that are well known in the industry using equipment such as a tubing head and tubing spool. Well control equipment are parts and devices known in the oil and gas industry as wellhead equipment, wellhead components and parts, blow out preventers that are also well known in the oil and gas industry and not described in this disclosure. Mounted above the wellhead assembly is the well control equipment that is used for pressure and fluid flow control during the fracking procedure and well treatment. The equipment is also used to secure and prevent well fluids from escaping into the atmosphere.

FIG. 5A shows variable pressure isolation tool 10 mounted to control valve 52, wherein control valve 52 is mounted to the top of variable high pressure transition tube 32 to control well pressure and/or fluid during the insertion and removal of variable high pressure transition tube 32 to prevent well fluids from escaping to atmosphere. FIG. 5A shows the system with variable pressure isolation tool 10. Control valve 52 can be hydraulically or manually operated or controlled. Hydraulic setting tool 136 includes a hydraulic cylinder, which is mounted to upper shank rod plate 132. Upper shank rod plate 132 includes passage 133 to permit piston polish rod 138 of a hydraulic cylinder to pass through upper shank rod plate 132. Upper shank rod plate 132 also includes at least two attachment points 135 for attachment of variable rod shank 122 to lower shank rod plate 14. Attachment points 135 are preferably equally spaced from passage 133, which itself is most preferably disposed in a center portion of upper shank rod plate 132, to ensure that the hydraulic cylinder and the piston rod align with control valve 52 to which the hydraulic cylinder attachment (not shown) is mounted. The hydraulic cylinder and variable rod shank 122 are respectively attached on their lower ends to lower shank rod plate 14 at corresponding attachment points 137. Lower shank rod plate 14 is supported by two or more variable rod shanks 122 that are identical in length and are manufactured with adjustment threads 130, which are most preferably coarse threads. This permits the upward or downward adjustment of upper shank rod plate 132 by rotating adjustment nuts 134 to accommodate variations in lengths or size of equipment. Variable rod shanks 122 are attached to the respective attachment points 135 and rod quick connect assemblies 120 on upper shank rod plate 132 and at respective attachment points 137 on lower shank rod plate 14 via threads or pins and nuts.

Piston polish rod 138 is attached to the top of control valve 52 by a connector so that mechanical force can be applied by pushing and applying force to top of unibody wireline valve adapter of well control to well control equipment protector and attached high pressure valve to stroke them in and out of the wellhead. When variable high pressure transition tube 32 is in the operative position shown in FIG. 5B, the bottom end of lower energizer ring 80 is in contact with wellhead seal bit guide 88 attached to a top of casing wellhead seal 144. Wellhead seal bit guide 88 covers casing 145 to protect the top end of casing 145 and provides a seal between casing 145 and wellhead assembly 142 in a manner well known in the industry as a secondary seal and/or casing wellhead seal 144.

As noted above, variable high pressure transition tube 32 has variable length adjustment 74 as illustrated FIG. 4. This variable adjustment allows hollow bullet nose seal assembly 94, including upper energizer ring 82, compression seal 78, and lower energizer ring 80 (which itself can optionally be formed from a metal material), to have adequate length to ensure that the top end of variable adjuster locking sleeve 70 extends above the top of unibody master housing 12 with just enough up and down adjustment to contact with control valve 52. Hollow bullet nose seal assembly 94 is secured by clamp 68 when lower energizer ring 80 is seated against wellhead seal bit guide 88. However, the distance from the top of wellhead seal bit guide 88 and the top of well control equipment 140 (see FIG. 5B) may vary to some extent in different wellheads. This variation cannot be accommodated by a conventional lockdown mechanism such as taught in U.S. Pat. No. 4,867,243. The presently claimed invention overcomes this shortcoming.

Figure 6:
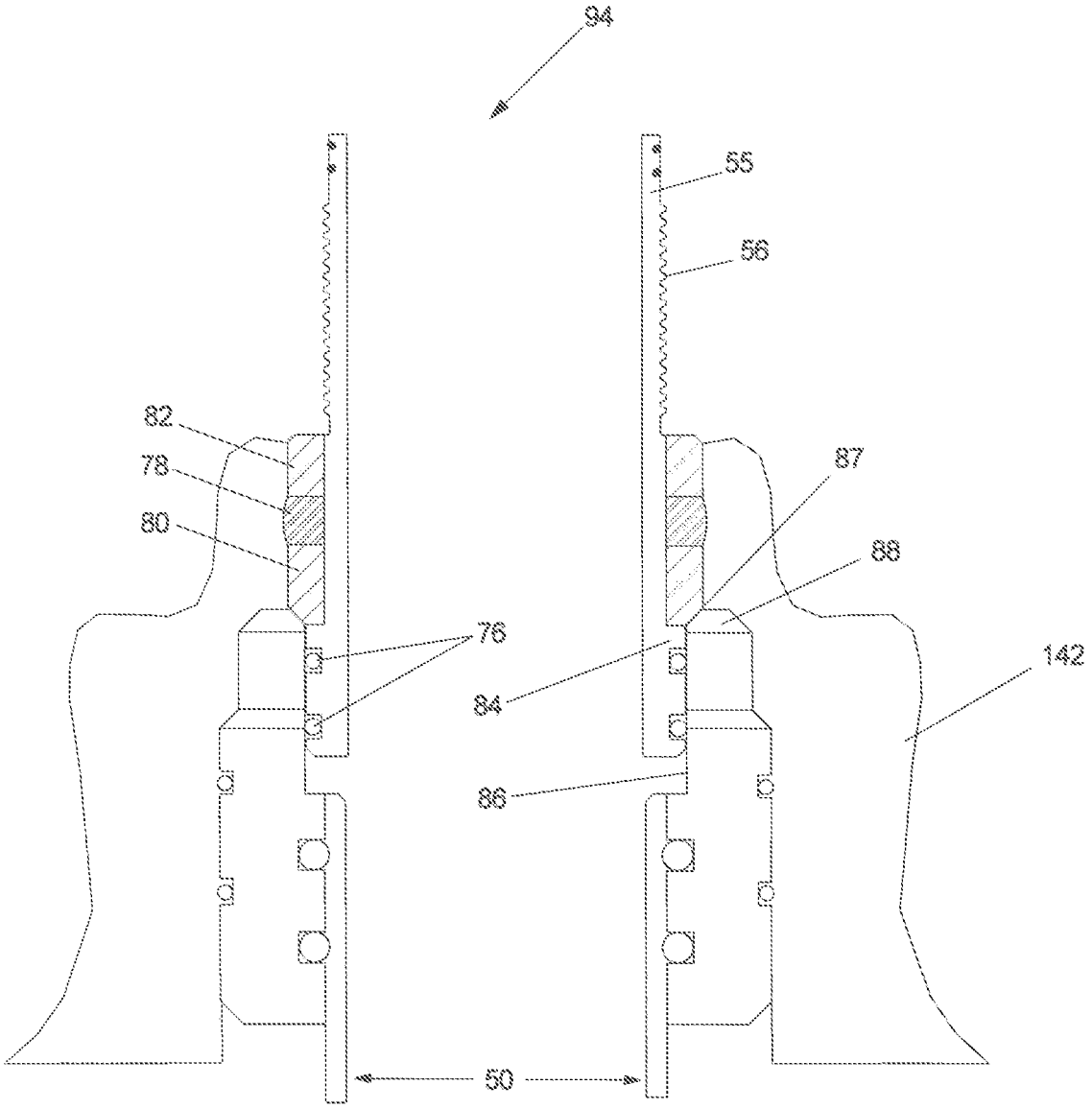
FIG. 6 is a partial cross-sectional view of an alternate preferred embodiment of an annular sealing body for sealing against the inner wall. It is inserted into a preinstalled casing sealing assembly that is inserted and installed to the casing and mounted and secured in the well control equipment.

FIG. 6 shows hollow bullet nose seal assembly 94, includes a unique design that eliminates the need for a separate retainer ring or separate no go. The assembly has bullet nose 55, with lower energizer ring 80, which seats or contacts tapered edge 87 (see FIG. 6) of wellhead bit guide 88 to act as a secondary seal. Lower energizer ring 80 is installed over threads 56 and slid down to no go stop 84. Compression seal 78 is installed by placing it over the top of hollow bullet nose 55 and then slipping over threads 56 to lower energizer ring 80. Upper energizer seal ring is also slipped over the top of hollow bullet nose 55 and threads 58 until it contacts compression seal 78. Hollow bullet nose seal assembly 94 is now installed to the bottom of variable high pressure transition tube 32, as shown in FIG. 1B.

As shown in FIG. 7, hollow bullet nose seal assembly 94 includes with a unique design that eliminates the need for a separate retainer ring or a separate no go. The assembly has hollow bullet nose 55, lower energizer ring 148, that seats or contacts tapered edge 87 (see FIG. 6) of wellhead bit guide 88. Lower energizer ring 148 is preferably configured with a radius taper positioned to force compression seal 146, which is most preferably formed from an elastomer, outward to force compression against the outer wall of the wellhead through bore as illustrated in FIG. 5B. The more force that is applied, the tighter the seal is applied to the bore wall ensuring a compression seal. Compression seal 146 is installed over hollow bullet nose 55 and threads 56 and slid down to no go stop 84. Compression seal 146 is installed by placing it over the top of hollow bullet nose 55 and slipping it down over threads 58 to lower energizer ring 148. The radius taper design of lower energizer ring 148 preferably matches the radius and/or taper of a bottom portion of compression seal 146. Upper energizer ring 82, which preferably acts as a seal, is also slipped over the top of hollow bullet nose 55 and threads 56 until it contacts compression seal 146. Hollow bullet nose seal assembly 94 is now installed to the bottom of variable high pressure transition tube 32 as shown in FIG. 1B.

FIG. 8 is an embodiment of an alternate seal as shown FIG. 5B. FIG. 8 illustrates an energizer ring, which is most preferably formed from a metal material, in contact with tapered edge 87 of wellhead bit guide 88 which compresses compression seal 78 when force is applied and used to compress the seal against the body of the wellhead bore known in the industry as a through bore. Tapered edge 87, is most preferably formed by machining an upper portion of wellhead bit guide 88. This force pushes the seal outward against the bore, which does not require a controlled tolerance or measurement, as in prior art energizer rings. Compression seal 78, which can be formed from polyurethane, is equipped with an outer seal prep 154 and an inner seal prep 152, these seals serve to pressure energize compression seal 78 without the need for compression. Compression is achieved by inner bore pressure, which compresses compression seal 78. The more pressure, the more compression, the tighter the seal. Hollow bullet nose seal assembly 94 is inserted and rotated into position by spiral threads 56 and complimentary threads 58 into high pressure tube where upper tube seal 44 contacts high pressure inner wall seal prep. Bore diameter 50 is equal to the diameter of casing wall 156 which gives the user full access to the well bore allowing tools to be inserted in and out of the well.

Although the claimed invention has been described in detail with particular reference to these preferred embodiments, other embodiments can achieve the same results. Variations and modifications of the presently claimed invention will be obvious to those skilled in the art and it is intended to cover in all such modifications and equivalents. The entire disclosures of all references, applications, patents, and publications cited above, are hereby incorporated by reference.

What is claimed is:

1. A method of isolating high pressure fluids for wellhead control equipment during stimulation or pumping operation, the method comprising:

inserting a variable transition tube into and through wellhead control equipment;

communicably coupling the variable transition tube to well casing or production tubing;

compressing a seal disposed around a hollow nose bullet, by compressing the seal with and between an upper energizer ring and a lower energizer ring by forcing the variable transition tube downward such that the lower energizer ring is forced against an upper portion of a wellhead seal bit guide, such that the seal expands to seal against a wall of a wellhead;

providing pressure containment with a tube seal disposed in a tube seal pocket of the hollow nose bullet; and causing a variable adjuster locking sleeve to secure a seal ring prep such that the seal ring prep provides backup pressure containment if the tube seal fails.

2. The method of claim 1 further comprising engaging a wellhead by forcing an elastomer seal outward to provide compression against an outer surface when hydraulic fluid force is applied.

3. The method of claim 2 wherein the elastomer seal is forced outward by a radius taper on a surface of the upper or the lower energizer ring.

4. The method of claim 1 further comprising adjusting a height of the variable adjuster locking sleeve via threads.

5. The method of claim 4 wherein adjusting a height comprises rotating the variable adjuster locking sleeve to contact a valve adapter.

6. The method of claim 1 further comprising locking down the variable adjuster locking sleeve via a safety locking ring.

7. The method of claim 1 further comprising testing a pressure of at least one adjuster sleeve port affixed to a master housing.

8. The method of claim 1 further comprising testing pressures via test ports in an upper valve adapter head affixed to the variable transition tube.

9. A method of isolating high pressure fluids for wellhead control equipment during stimulation or pumping operation, the method comprising:

inserting a variable transition tube into and through wellhead control equipment;

communicably coupling the variable transition tube to well casing or production tubing;

compressing a seal disposed around a hollow nose bullet, by compressing the seal with and between an upper energizer ring and a lower energizer ring by screwing the hollow nose bullet onto a lower end of the variable transition tube such that a lower end of the variable transition tube presses down on an upper portion of the upper energizer ring, such that the seal expands to seal against a wall of a wellhead;

providing pressure containment with a tube seal disposed in a tube seal pocket of the hollow nose bullet; and causing a variable adjuster locking sleeve to secure a seal ring prep such that the seal ring prep provides backup pressure containment if the tube seal fails.

10. The method of claim 9 further comprising engaging a wellhead by forcing an elastomer seal outward to provide compression against an outer surface when hydraulic fluid force is applied.

11. The method of claim 10 wherein the elastomer seal is forced outward by a radius taper on a surface of the upper or the lower energizer ring.

12. The method of claim 9 further comprising adjusting a height of the variable adjuster locking sleeve via threads.

13. The method of claim 12 wherein adjusting a height comprises rotating the variable adjuster locking sleeve to contact a valve adapter.

14. The method of claim 9 further comprising locking down the variable adjuster locking sleeve via a safety locking ring.

15. The method of claim 9 further comprising testing a pressure of at least one adjuster sleeve port affixed to a master housing.

16. The method of claim 9 further comprising testing pressures via test ports in an upper valve adapter head affixed to the variable transition tube.

* * * * *